US008408113B2

(12) United States Patent
Ledbetter, III et al.

(10) Patent No.: US 8,408,113 B2
(45) Date of Patent: Apr. 2, 2013

(54) MACHINE GUN SPENT BRASS CATCH DEVICE

(76) Inventors: John W. Ledbetter, III, Mt. Pleasant, SC (US); Francisco Cordero, Jr., North Charleston, SC (US); Alan Foster Johnson, Summerville, SC (US)

( * ) Notice: Subject to any disclaimer, the term of this patent is extended or adjusted under 35 U.S.C. 154(b) by 417 days.

(21) Appl. No.: 12/590,348

(22) Filed: Nov. 6, 2009

(65) Prior Publication Data

US 2011/0107903 A1 May 12, 2011

(51) Int. Cl.
*F41A 9/60* (2006.01)

(52) U.S. Cl. ..... 89/33.4; 42/98; 220/9.4; 206/3; 383/12; 383/67

(58) Field of Classification Search ..... 42/98; 89/33.4; 220/9.1, 9.4, 651, 652, 653; 206/3, 317; 383/12, 13, 22, 33, 67, 97
See application file for complete search history.

(56) References Cited

U.S. PATENT DOCUMENTS

| | | | | | |
|---|---|---|---|---|---|
| 1,304,468 | A | | 5/1919 | Fernandez | |
| 2,524,352 | A | * | 10/1950 | Kiser | 220/9.1 |
| 3,153,981 | A | | 10/1964 | Brass | |
| 3,739,685 | A | | 6/1973 | Lundgren | |
| 3,771,248 | A | | 11/1973 | Linehan | |
| 4,028,834 | A | | 6/1977 | Dobson | |
| 4,110,927 | A | | 9/1978 | Morris | |
| 4,151,996 | A | | 5/1979 | Lee et al. | |
| 4,296,565 | A | | 10/1981 | Jaffin et al. | |
| 4,334,375 | A | | 6/1982 | Olson | |
| 4,715,141 | A | * | 12/1987 | Kohnke | 42/98 |
| 4,903,426 | A | | 2/1990 | Bammate | |
| 4,959,918 | A | | 10/1990 | Perez | |
| 5,138,787 | A | | 8/1992 | Riddle et al. | |
| 5,651,208 | A | | 7/1997 | Benson | |
| 5,664,727 | A | | 9/1997 | Beall | |
| 5,785,175 | A | * | 7/1998 | Cholsaipant | 206/386 |
| 5,811,716 | A | | 9/1998 | Ellzey | |
| 5,934,002 | A | | 8/1999 | Blanchet | |
| 6,173,520 | B1 | | 1/2001 | Bucciarelli et al. | |
| 6,347,475 | B1 | | 2/2002 | Trostel | |
| 6,354,035 | B1 | | 3/2002 | Niebuhr et al. | |
| 6,402,378 | B1 | * | 6/2002 | Shackleton | 383/119 |
| 6,675,693 | B1 | | 1/2004 | Heayn | |
| 6,836,991 | B1 | | 1/2005 | Saur | |
| 7,043,863 | B2 | | 5/2006 | Saur | |
| 7,134,233 | B1 | | 11/2006 | Saur | |
| 7,168,200 | B2 | | 1/2007 | Perez et al. | |
| 7,258,055 | B1 | | 8/2007 | Javorsky | |
| 7,536,821 | B1 | | 5/2009 | Saur | |
| 7,543,524 | B1 | | 6/2009 | Javorsky | |
| 2002/0007581 | A1 | | 1/2002 | Bucciarelli et al. | |
| 2008/0092728 | A1 | | 4/2008 | Stussak et al. | |
| 2008/0101731 | A1 | * | 5/2008 | Carlson | 383/41 |
| 2009/0151215 | A1 | | 6/2009 | Saur | |

* cited by examiner

*Primary Examiner* — Gabriel Klein

(57) ABSTRACT

A catch device for collecting ejected cartridges and other spent brass from an automatic fire machine gun or the like mounted on a platform includes: (a) a frame portion including an open mouthed, rigid bag frame, and a latch assembly on the bag frame; and (b) a catch bag portion including a collection bag with a hollow interior, a zipper, or a bottom flap with hook and loop strip, closing a bottom slot of the collection bag, at least one attachment mechanism at the top of the collection bag, and at least one flexible cross member extending across the collection bag interior, the catch bag portion being attachable to the frame portion by the attachment mechanism. This simplified abstract is not intended to limit, and should not be interpreted as limiting, the scope of the claims.

20 Claims, 8 Drawing Sheets

MACHINE GUN SPENT BRASS CATCH DEVICE

BACKGROUND OF THE INVENTION

1. Technical Field

The present invention relates to a catch device for capturing ejected cartridge casings, links, and other spent brass material from an automatic fire machine gun mounted in a platform, such as a tank or other vehicle.

2. Background Information

Leaving a signature trail of spent machine gun cartridges, links, or other spent brass from a moving platform, such as a tank or other vehicle, during a battle can allow the enemy to track your company's movement. Leaving a trail of spent brass during battles or training maneuvers, for example, adversely affects the environment. Catching spent brass in a separate refuse can within the confines of a tank poses problems for the machine gun operator. Also, a military tank gunner does not have time to repeatedly empty a rapidly filling refuse bin during combat. The same is true for the spent brass ejected from a rapid fire machine gun mounted in a military helicopter, boat, jeep, truck, or the like.

The spent brass catch device of the present invention, which is made of fire retardant materials, detachably attaches to a machine gun apparatus that is mounted in a military track vehicle, boat, rotor or fixed wing, wheeled vehicle, or the like. The instant spent brass catch device includes a generally rectangular-shaped bag frame with a latch assembly for attachment to the machine gun apparatus, and a collection bag. Since space is important in a military vehicle or rotor or fixed wing planes, the collection bag includes internal cross members that prevent the collection bag from expanding to an unacceptable width as it is being filled with the spent cartridges and other brass. The bag cross members permit the collection bag to fit into the allotted space in the tank or other platform. When the collection bag is full, it can quickly be emptied by unzipping a zipper at the bottom of the collection bag. It is not necessary to disconnect the collection bag in order to empty it. Rather than being released to the environment, brass from the collected spent cartridges, links, etc. can be recycled at a later time. Collecting brass cartridges and link refuse and recycling it saves the government a substantial amount, and denies the enemy from collecting the refuse and recycling it themselves for weapon usage or profit.

The machine gun has had a tremendous impact on modern warfare, helping the Allies to win both World War I and World War II. Many thousands of mounted heavy machine guns are currently in use around the world. An effective means of collecting spent brass ejected from mounted machine guns can therefore have a significant beneficial effect on the environment and translate to significant cost savings for the military, particularly when multiplied by the number of heavy machine guns in use by the military.

BRIEF SUMMARY OF THE INVENTION

The present invention is a catch device for catching ejected cartridge casings, links, and other spent brass material from an automatic fire machine gun or the like mounted in a tank or other vehicle. The device comprises: (a) a frame portion including an open mouthed, rigid bag frame, and a latch assembly mounted on the bag frame; and (b) a catch bag portion including a collection bag having a hollow interior, a zipper, or a bottom flap with a hook and loop strip, closing a slot at the bottom of the collection bag, at least one attachment mechanism at the top of the collection bag, and at least one flexible cross member extending across the interior of the collection bag; wherein the catch bag portion is attachable to the frame portion by the attachment mechanism.

Advantages of the spent brass catch device of the present invention include the following:

1) easily and detachably latches to an existing machine gun apparatus in a tank or other military platform;
2) the collection bag fits into the small amount of allotted space in the tank or other military platform in which the machine gun is mounted;
3) made of fire retardant materials so that it does not pose a danger to the vehicle's occupants;
4) includes unique internal cross members that help the collection bag retain its shape, even as it fills with the spent brass;
5) the full collection bag can quickly and easily be emptied by unzipping a zipper at the bottom of the collection bag, without disconnecting the collection bag from the machine gun apparatus;
6) brass from the collected spent cartridge casings, links, etc. can be stored and recycled at a later time, which helps the environment and leads to cost savings; and
7) the tank gunner has more time to perform other tasks, since he or she does not have to station a refuse can beneath the machine gun to catch the spent brass and worry about the refuse can tipping over, emptying the refuse can when it is full, and the ejection chute clogging up due to overflow.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
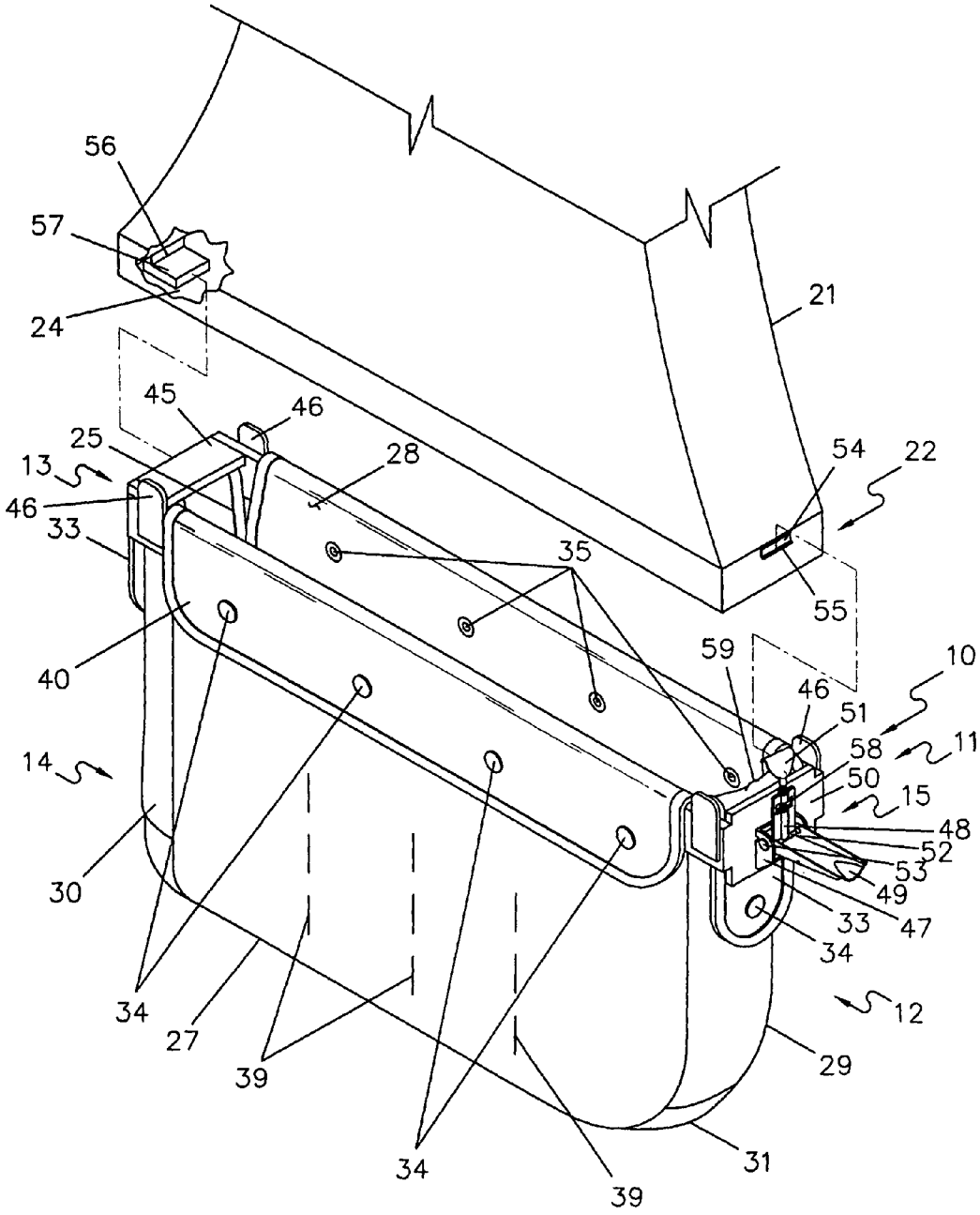
FIG. 1 shows a perspective view of a spent brass catch device according to the present invention, shown adjacent a portion of a machine gun chute.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a device embodying the principles and concepts of the present invention and generally designated by the reference numeral 10 will now be described.

Figure 2:
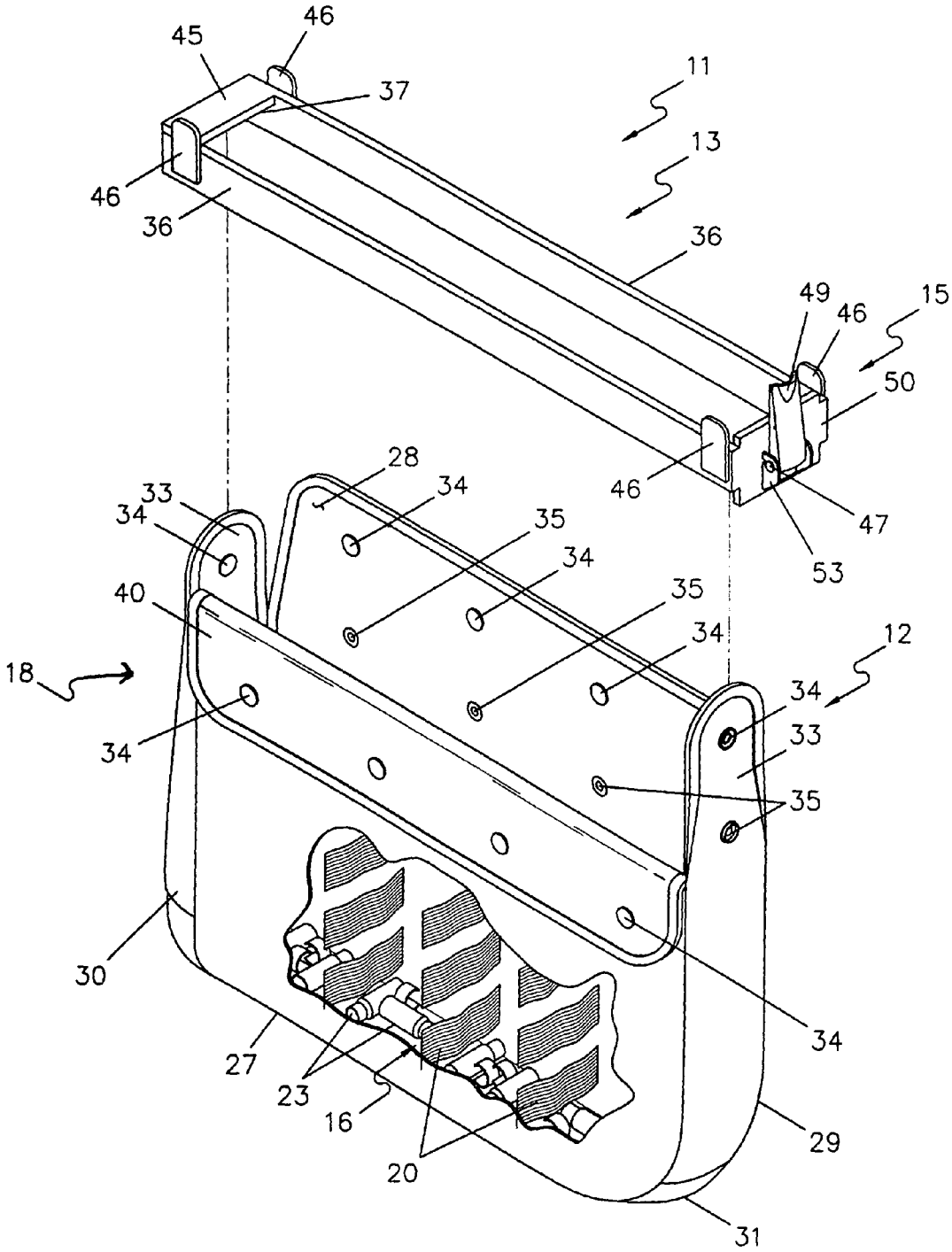
FIG. 2 is a perspective view of a spent brass catch device according to the present invention, shown expanded and disassembled.
Figure 3:
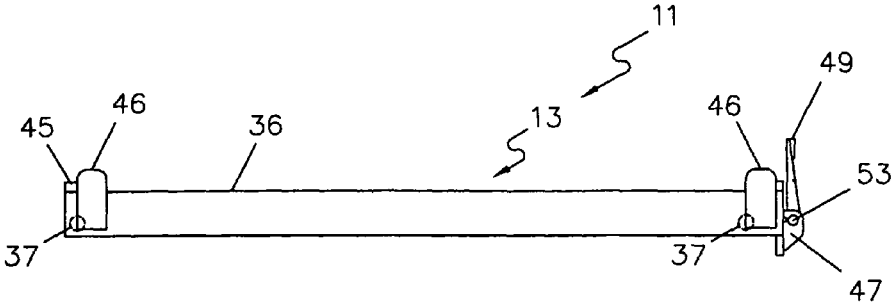
FIG. 3 is a side elevational view of a bag frame of the spent brass catch device according to FIG. 2.

Turning first to FIGS. 1 and 2, a spent brass catch device 10 catches and collects spent brass materials 23 ejected from a heavy duty machine gun mounted on a platform, such as a tank or other vehicle, or an aircraft or boat. The spent brass catch device 10 comprises: (a) a frame portion 11 comprising an open mouthed, rigid bag frame 13, and a latch assembly 15 mounted on the bag frame 13 for latching the catch device 10 to a corresponding frame 22 on the chute 21 of a machine gun apparatus or the like; and (b) a catch bag portion 12 comprising a collection bag 14 having a hollow interior 16, a zipper 26 closing a slot at the bottom of the collection bag 14, at least one attachment mechanism 18 at the top of the collection bag 14, and at least one flexible cross member 20 extending across the interior 16 of the collection bag 14; wherein the catch bag portion 12 is attachable to the frame portion 11 by the attachment mechanism 18. Preferably, the chute frame 22 and the bag frame 13 are both generally rectangular in shape and correspond in size. The catch device may include a bottom flap 43 with a hook and loop strip 44 instead of a zipper at the bottom of the collection bag.

The frame portion 11 of the spent brass catch device 10, which is shown in an assembled position in FIG. 1, attaches to a corresponding chute frame 22 on a machine gun chute 21 of the mounted machine gun (not shown). When the catch device 10 is in use, spent cartridges, links, and other brass ejected from the machine gun are directed into the top of the chute 21 as the machine gun fires. The spent brass 23 tumbles down the machine gun chute 21 and down through the open mouth of the catch device 10 by the weapon ejection force and then by gravity. The catch device 10 is suspended beneath the opening at the bottom of the chute 21 and moves up and down as the chute 21 moves when the machine gun is in use. The spent brass 23 is ejected into and collected in the collection bag 14 (see FIG. 2). As seen in FIG. 1, the chute frame 22 is at the bottom of the chute 21 in the chute opening 24. The mouth of the collection bag is held open by the bag frame 13. The frame portion 11 of the catch device 10 attaches to the chute frame 22, as described herein. By "spent brass" is meant cartridge casings, links, broken pieces of cartridge and links, and other material ejected from the machine gun, most of which has a high brass content.

Figure 6:
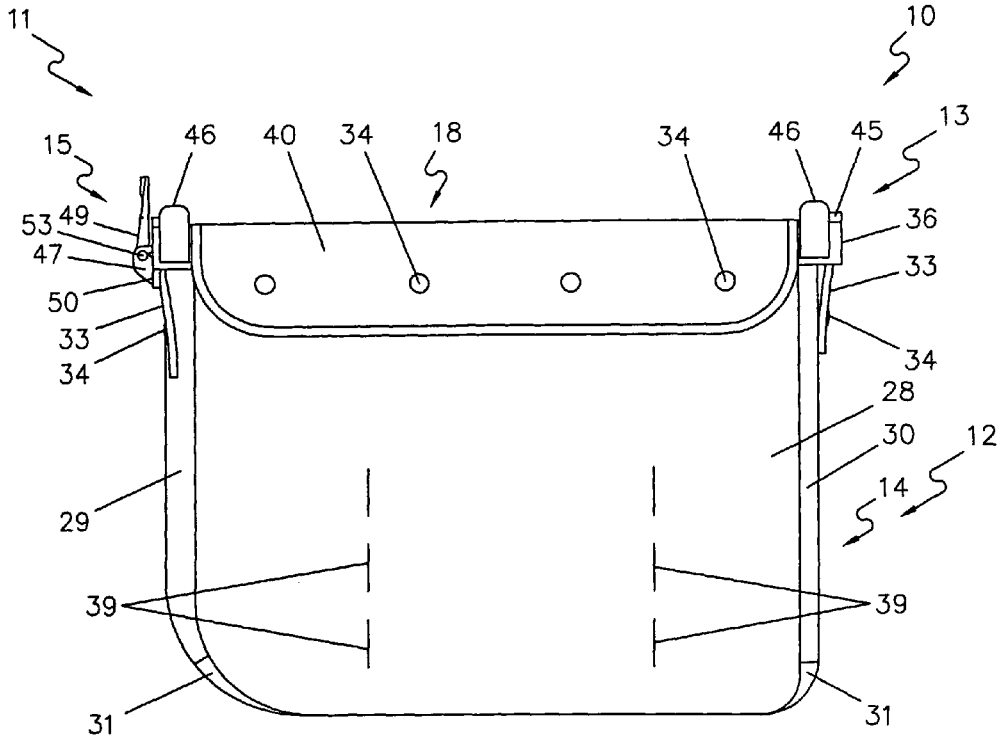
FIG. 6 is a side elevational view of a spent brass catch device according to the present invention.
Figure 7:
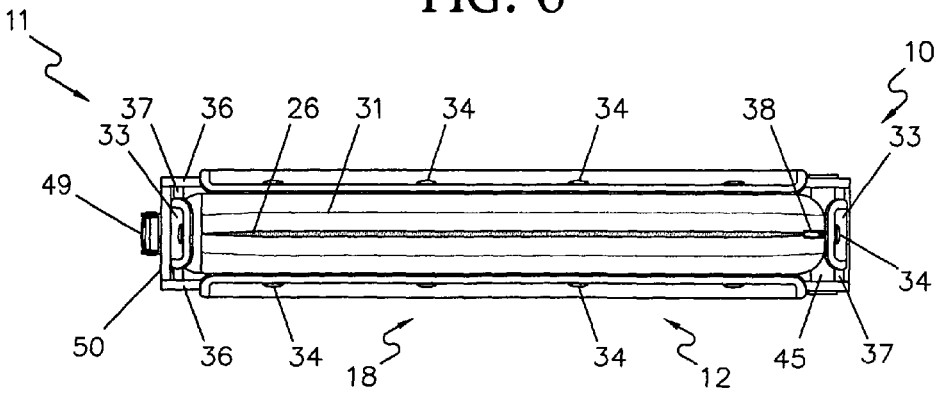
FIG. 7 is a bottom plan view of the spent brass catch device according to FIG. 7.

The hot spent brass 23 begins to cool as it falls through the chute 21 and as it rests in the collection bag 14 (see FIGS. 1 and 2). The collection bag 14 is made of fire retardant materials. Once the collection bag 14 is substantially full of spent brass 23, the collection bag is emptied by unzipping the zipper 26 at the bottom of the collection bag 14, as seen in FIGS. 6 and 7.

In addition to an armored tank, the machine gun may be mounted on any platform that can accommodate it. By "platform" is meant an aircraft, boat, track vehicle, wheeled vehicle, or stationary base. The catch device 10 is capable of catching and collecting any type of spent brass ejected from the machine gun, in addition to spent cartridges and links. In addition to a heavy machine gun, the rapid fire gun from which the spent brass 23 is ejected may be any other suitable type of automatic fire weapon, such as future fighting weapons. In addition to a chute portion of the automatic fire gun apparatus, other suitable means can be used to channel the spent brass ejected from the automatic fire gun into the mouth of the catch device, such as a machine gun ejection channel or any cartridge ejecting weapon.

First, the catch bag portion 12 as illustrated in FIGS. 1, 2, and 5-7 includes a collection bag 14 with a hollow interior 16. The collection bag 14 shown in FIGS. 1, 2, and 6 includes a bag front section 27, an opposite, symmetrical bag rear section 28, a latch side gusset 29, a second side gusset 30 opposite the latch side gusset 29, and a bag base section 31 with a longitudinal slot 32 for the closable zipper 26. These bag sections 27-31 surround the interior 16 of the collection bag 14. The bag front and rear sections 27, 28 are preferably made using the same template. The templates for the latch side gusset 29 and second side gusset 30 of the collection bag 14 shown in FIG. 2 are similar in shape, but the latch side gusset 29 has a substantially longer tongue 33 at the top than the other, second side gusset 30. Other templates can be used to form the collection bag 14. The edges of the bag sections 27-31 are sewn or otherwise attached to one another to form the collection bag 14 seen in FIG. 2. The collection bag 14 is made of a sturdy, fire retardant, heat resistant material to protect the gunner and other occupants of the tank or other platform on which the machine gun apparatus is mounted. The collection bag 14 can be made of a large piece or pieces of material, or multiple smaller pieces that are sewn or otherwise attached together. The collection bag may have other shapes, such as triangular or oval.

Secondly, the catch bag portion 12 seen in FIGS. 1, 2, and 5-7 includes an attachment mechanism 18 for detachably attaching the catch bag portion 12 to the bag frame 13. This (upper) attachment mechanism 18 is preferably a number of snaps, although any suitable, sturdy attachment mechanism may be employed. As seen in FIG. 2, the bag front and rear sections 27, 28 each include two rows of spaced apart snap portions of the snaps. The upper row of cap and socket snap portions 34 extends along an upper edge of the bag front and rear sections 27, 28. A second, lower row of post and stud snap portions 35 corresponding to the cap and socket snap portions 34 are located below the first row of snap portions on the bag front and rear sections 27, 28. As seen in FIGS. 1 and 2, each cap is attached to a corresponding socket on the opposite face of the bag front and rear sections 27, 28, forming a cap and socket snap portion 34. Similarly, each post is attached to a corresponding stud on the opposite face of the bag front and rear sections 27, 28, forming a post and stud snap portion 35.

The seams between the bag front and rear sections 27, 28 and the side gussets 29, 30 do not extend the full length of the sides of the front and rear sections, leaving upper flaps 40 at the top of the front and rear sections 27, 28 and the tongues 33 at the top of the side gussets 29, 30. When the upper flap 40 of the bag front section 27 is flapped down, the cap and socket snap portions 34 are aligned with the post and stud snap portions 35. Also, the cap and socket snap portions 34 are aligned with the post and stud snap portions 35 when the upper flap 40 of the bag rear section 28 is down. The number of heavy duty snaps on each section, front and rear, varies, usually according to the size of the collection bag.

To assemble the spent brass catch device 10, the upper flap 40 of the front section 27 of the collection bag 14 is extended over one longitudinal rail 36 of the bag frame 13, and then the cap and socket snap portions 34 are each snapped to a corresponding post and stud snap portion 35. The upper flap 40 of the bag rear section 28 is also extended over the other longitudinal rail 36 of the bag frame 13, and the cap and socket snap portions 34 are each snapped to corresponding post and stud snap portions 35.

Each side gusset 29, 30 also has a cap and socket snap portion 34, and a post and stud snap portion 35 below the cap and socket snap portion on the gusset tongue 33. By "tongue" is meant the tongue-shaped top portion of each side gusset that is not seamed to the bag front and rear sections. When the tongue 33 of each side gusset is extended down over a transverse bag bar 37 at an end of the bag frame 13, the cap and socket snap portion 34 aligns with the corresponding post and stud snap portion 35 on that side gusset. The transverse bag bars 37 of the bag frame 13 are substantially perpendicular to and between the frame longitudinal rails 36, and the ends of the shorter transverse bag bars 37 connect to the frame longitudinal rails 36.

The user ordinarily uses a thumb to press the cap of the cap and socket snap portion 34 onto the stud of the corresponding post and stud snap portion 35 to snap the snap portions 34, 35 together. (The socket can be seen inside the cap, and the post can be seen inside the stud.) Once the collection bag 14 is on the bag frame 13 and all the snaps 18 on the front and rear sections 27, 28 and the two side gussets 29, 30 are closed, the catch device 10 is assembled and ready for attachment to the chute frame 22. An alternate mechanism for attaching the catch bag portion to the bag frame may be used. The frame can be made by any suitable method.

Figure 5:
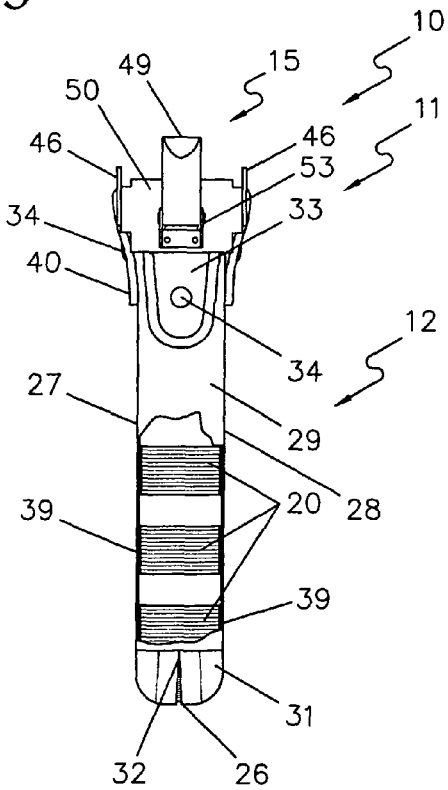
FIG. 5 is an end elevational view of a spent brass catch device according to the present invention.

Thirdly, the catch bag portion 12 seen in FIGS. 1, 2, and 5-7 includes the zipper 26 at the bottom. The openable and closable zipper 26 is installed along the slot 32 that extends along the longitudinal axis of the bottom of the catch bag portion 12, as seen in FIG. 7. The zipper 26 shown in FIGS. 5 and 7 is sewn into the bottom slot 32 in the base section 31 of the collection bag 14. The heavy duty zipper 26 includes a zipper pull 38 that is itself easy to grasp, or which has a pull extension attached to the zipper pull 38 to make the zipper easier and quicker to open. The zipper 26 is preferably opened from the second side gusset end of the base section 31 toward the latch side gusset end of the base section 31 (see FIG. 7). When the spent brass catch device 10 is installed in the tank, this direction is from the rear of the tank to the front of the tank, which is believed to make it easier for the gunner to quickly open the zipper 26, which allows the collection bag to empty, and then close the zipper.

The spent brass 23 is usually somewhat cooled by the time the collection bag 14 is unzipped, making it easier to handle the spent brass, if it becomes necessary to do so. It is ordinarily not necessary to handle the spent brass 23, though, since it can be collected in a suitable container as it falls by gravity out through the bottom slot 32 at the bottom of the collection bag 14.

Fourthly, the catch bag portion 12 seen in FIGS. 1, 2, and 5-7 includes at least one cross member 20. Each cross member 20 extends substantially transversely across the hollow bag interior 16, as seen through the cutout illustrated in FIG. 2 for purposes of illustration. As seen in the cutout of FIG. 5, each cross member 20 is attached at its opposite ends to the interior surfaces of the bag front and rear sections 28, 29, as by sewing at cross member seams 39. The cross members 20, then, extend substantially parallel to each other and to the side gussets 29, 30, as seen in FIG. 6, and substantially perpendicular to the front and rear sections 27, 28, as seen in FIG. 2. The spent brass catch device 10 more preferably includes at least two, most preferably between about six and about 12, of the cross members 20, as required to maintain the desired collection bag shape. The cross members 20 are preferably flexible and spaced apart from one another. The cross members 20 are made of a fire resistant or heat resistant material, such as webbing material.

The spent brass catch device 10 seen in FIG. 2 most preferably includes about nine substantially same sized cross members 20. In the particular catch bag portion 12 of FIG. 2, the three sets of three cross members 20 divide the lower portion (preferably about the lower half) of the hollow bag interior 16 into four substantially even sections (fourths). Spent cartridges and other brass 23 entering through the mouth 25 of the catch device 10 fall randomly into the interior 16 to fill the catch device 10. A spent cartridge striking an upper cross member 20 will fall to one side or the other of that cross member. FIG. 6 shows a variation: six seams indicating two sets of six same sized cross members 20 extending across the bag interior, each set having three cross members. Cross members may be added or deleted as needed for the particular weapon system.

It has been found herein that the spent brass catch device 10 is most effective when the internal cross members 20 are sewn across the lower half of the collection bag 14, as seen in FIGS. 1 and 2. The opposite ends of the cross members 20 are attached to the front and rear sections 27, 28, preferably by sewing at cross member seams 39, as seen in FIGS. 1, 5, and 6. In the spent brass catch device 10 shown in FIG. 2, each of the three rows has three same sized cross members 20. The cross members 20 are substantially parallel to one another.

The cross members 20 are each about the same length as the side gussets once the side gussets are sewn into the collection bag. The cross members 20 will not permit the collection bag 14 to expand to a width that is greater than the length of the cross members. Preferably, but not necessarily, each cross member 20 is between about three and about five inches in length, and between about ½ inch and about two inches in width. The cross members 20 are preferably spaced between about ½ inch and about two inches apart from one another. They help the collection bag retain its shape and fit into the limited space allocated for it.

The internal cross members 20 allow the collection bag 14 to retain the desired shape, even as it is filled with the spent brass. This permits the collection bag to fit into the small space available for it in the tank or other platform in which the machine gun is mounted. Once the collection bag 14 is expanded to its maximum width and the flexible cross members 20 are stretched to their maximum length, the spent brass 23 has nowhere to go but up in the catch bag portion. The spent brass 23 then stacks up in the three sections formed by the three sets of cross members 20, with some cartridges, etc. falling around the cross members. The spent brass 23 reaches the top of the uppermost cross members 20 and the catch bag portion continues filling up to the top. The catch bag portion 12 can then be emptied by opening the zipper 26 at the bottom of the collection bag.

Figure 9:
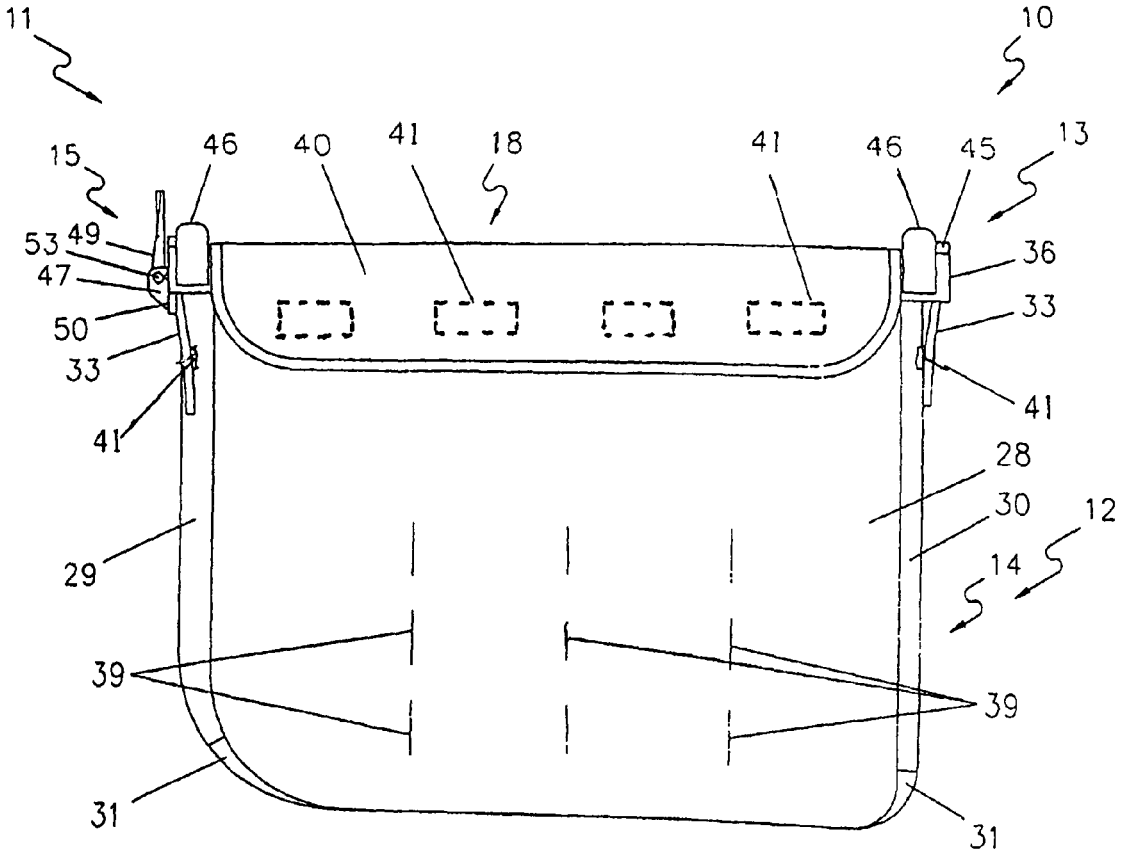
FIG. 9 is a side elevational view of a spent brass catch device according to the present invention, with a hook and loop attachment mechanism.

Turning to FIG. 9, the catch bag portion 12 may include an alternate attachment mechanism 18 for detachably attaching the catch bag portion to the bag frame 13 instead of snaps: hook and loop segments 41. A first hook or loop portion of a hook and loop segment 41 is attached to the front face of the front or rear section 27, 28, and a corresponding, second hook or loop portion is attached to the bottom of the upper flap 40 of the same front or rear section. Similarly, a first hook or loop portion is attached to the front face of the side gusset 29, 30, and a corresponding, second hook or loop portion is attached on the tongue 33 of the same side gusset 29, 30 above the first hook or loop portion, with similar placement to the snaps shown in FIG. 2.

Once the collection bag 14 is on the bag frame 13, the corresponding hook and loop portions on the front and rear sections 27, 28 are attached to one another, as seen in FIG. 9. The corresponding portions of the hook and loop segments 41 on the two side gussets 29, 30 are also closed (attached). The catch device 10 is thus assembled and ready for attachment to the chute frame 22. Once the military exercise or other use of the catch device is over, the hook and loop segments 41 can easily be pulled apart and the collection bag 14 can be removed from the bag frame 13 for replacement, etc., as desired.

Figure 10:
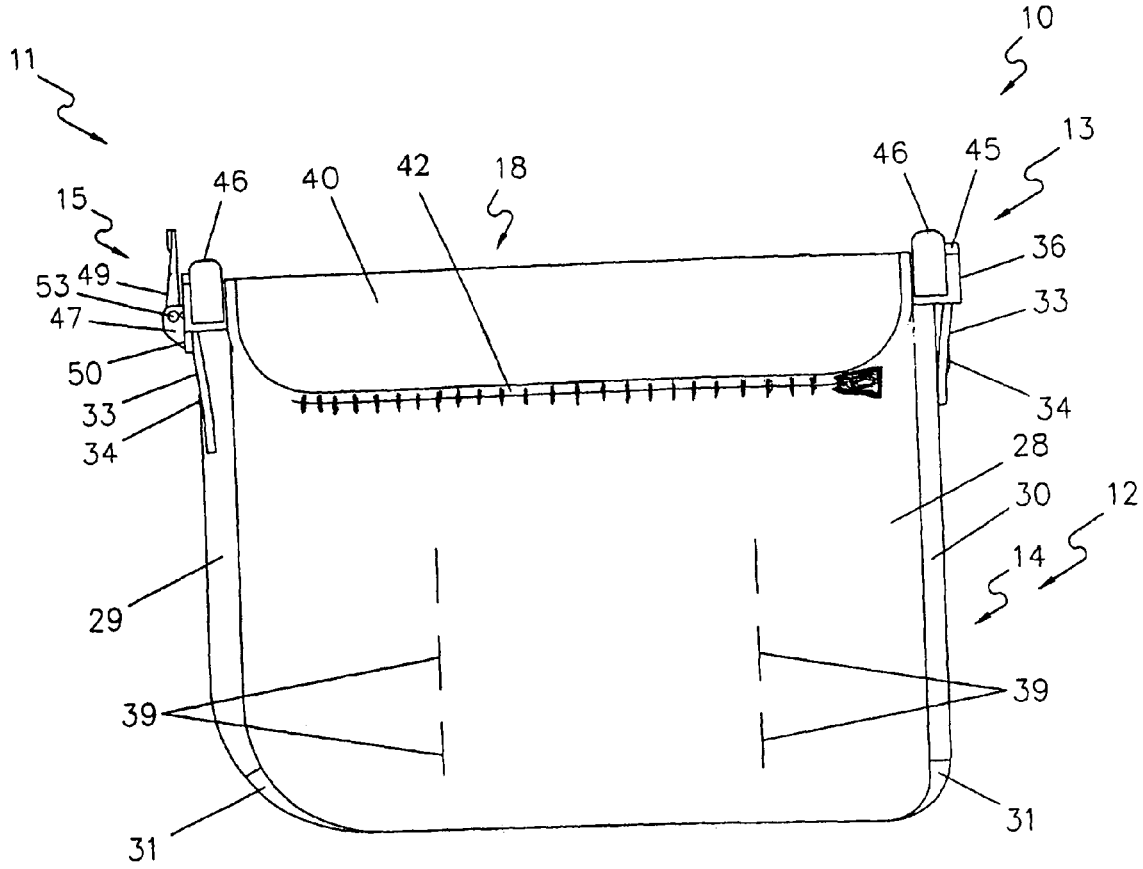
FIG. 10 is a side elevational view of a spent brass catch device according to the present invention, with flap zippers.

Referring to FIG. 10, a second, less preferred attachment mechanism 18 for detachably attaching the catch bag portion 12 to the bag frame 13 includes a side zipper 42 on each upper flap 40 (front and back). The flap zipper 42 is attached along the edge of each upper flap 40. A first portion of the flap zipper 42 is attached to the front face of the front or rear section 27, 28, and a corresponding, second portion of the flap zipper 42 is attached to the edge of the upper flap 40 of the same front or rear section. In the assembled position, the longitudinal rail 36 of the bag frame 13, the flap zipper 42, and the bag base section 31 are substantially parallel to one another. In this catch device, each side gusset 29, 30 has a cap and socket snap portion 34, and a post and stud snap portion 35 below the cap and socket snap portion on the gusset tongue 33, with similar placement to the snap portions shown in FIG. 2.

Continuing with FIG. 10, the corresponding portions of the flap zippers 42 are pressed lightly together once the collection bag 14 is on the bag frame 13. Once the tongue 33 of each side gusset is extended down over the corresponding transverse bag bar 37 at an end of the bag frame 13, the cap and socket snap portion 34 aligns with the corresponding post and stud snap portion 35 on that side gusset. The user presses the cap of the cap and socket snap portion 34 to the stud of the post and stud snap portion 35, which snaps the snap portions together. The catch device 10 is thus assembled and ready for attachment to the chute frame 22. Once the military exercise or other use of the catch device is over, the side gusset snaps can easily be unsnapped and the flap zippers 42 can easily be unzipped, and the collection bag 14 can be removed from the bag frame 13 for replacement, etc., if desired.

Figure 11:
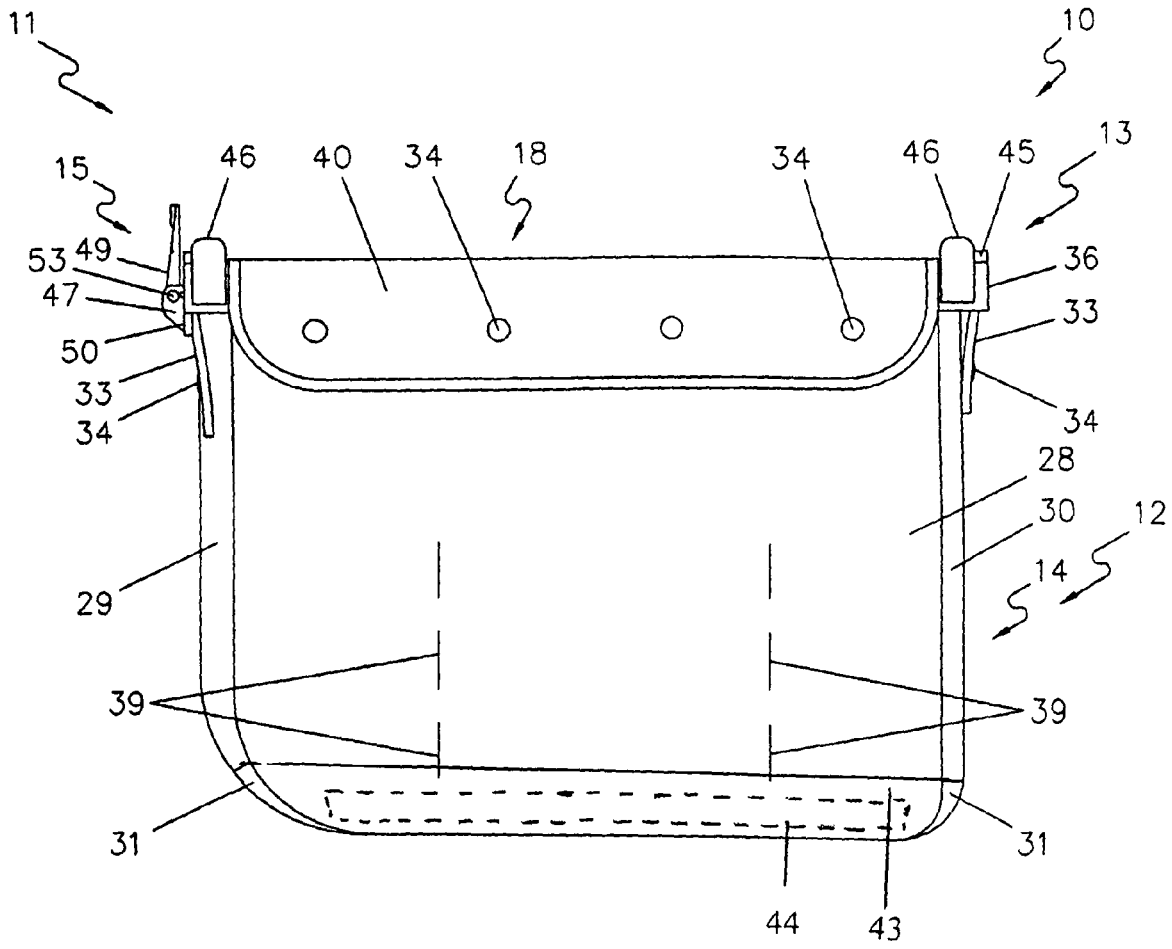
FIG. 11 is a side elevational view of a spent brass catch device according to the present invention, with a bottom flap having a hook and loop strip.

The catch bag portion 12 shown in FIG. 11 includes a bottom flap 43 at the bottom of the collection bag 14 with a hook and loop strip 44 (instead of a bottom zipper). In this catch device, the bag base section 31 includes a bottom flap 43 that extends over the slot 32 (like FIG. 7) at the bottom of the collection bag 14. A first hook or loop portion of the bottom hook and loop strip 44 is attached to the front face of the front or rear section 27, 28 from one end of the bottom slot 32 to the other. A corresponding, second hook or loop portion of the hook and loop strip 44 is attached to the rear face of the bottom flap 43 (see dashed lines in FIG. 11). The bottom flap 43 preferably attaches to the bottom part of the front section 27, since that is ordinarily adjacent the gun operator. The gun operator can then easily reach over and grasp the bottom flap 43 without moving from his or her seat.

Once the collection bag 14 of FIG. 11 appears to be full, the gun operator pulls the bottom flap 43 down, separating the two portions of the hook and loop strip 44. Opening the bottom slot 32 allows the spent brass 23 to fall out of the collection bag 14 by gravity into a suitable container. The spent brass contents are preferably emptied into an empty ammunition can and stored until the spent brass is recycled. This encourages the recycling of ammo cans rather than opening the vehicle hatch, for example, and discarding the contents of the ammo cans once the ammunition inside has been used.

Turning to the frame portion 11 of the catch bag device 10, which is shown in FIGS. 2-5, the frame portion 11 includes the bag frame 13 and the latch assembly 15. The latch assembly 15 is mounted on the bag frame 13. The bag frame 13 and latch assembly 15 are made of a durable metal, preferably steel. The open mouth 25 of the catch device, which is bordered by the longitudinal rails and transverse bars, receives the spent brass 23 from the automatic fire gun.

In addition to the two substantially parallel frame longitudinal rails 36 and the transverse bag bars 37, the bag frame 13 includes a gusset bar 45 at the second end of the bag frame 13, and tabs 46 attached to the end portions of the longitudinal rails 36. The second, gusset bar end of the bag frame is opposite the first, latch assembly end of the bag frame. The opposite ends of the substantially rectangular shaped gusset bar 45 are attached to the top of the end portions of the opposite longitudinal rails 36, as seen in FIG. 2. The gusset bar 45 extends over and is substantially parallel to the transverse bag bar 37. Preferably, each transverse bag bar 37 is round (in transverse cross section), and each longitudinal rail 36 is substantially rectangular in shape. The gusset bar 45 is also rectangular in shape in the frame shown in FIG. 1.

Continuing with the bag frame 13 shown in FIGS. 2-5, a first set of two of the matching tabs 46 are attached to the outside of the end portions of the longitudinal rails 36 and to the opposite ends of the gusset bar 45. A second set of the tabs 46 is attached to the outside of the opposite end portions of the opposite longitudinal rails 36. Preferably, there are four substantially identical tabs 46, each having a flat, tombstone shape. The curved tops of the tabs 46 all extend above the longitudinal rails 36.

Figure 4:
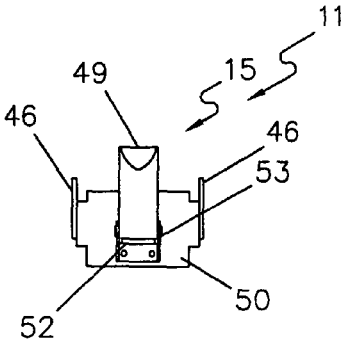
FIG. 4 is an end elevational view of the bag frame of a spent brass catch device according to FIG. 3.

As seen in FIGS. 4 and 5, the latch assembly 15 includes a latch hinge 47, a clasp arm 48, and a latch cover 49 associated with the clasp arm 48 and pinned at the latch hinge 47. The rear of the latch hinge 47 is attached to the front face of the latch back plate 50. The ends of the latch back plate 50 are attached to the latch assembly ends of the longitudinal rails 36, which are opposite the gusset bar ends of the longitudinal rails. The latch cover 49 is slightly longer and wider than the clasp arm 48, which fits within a recess in the inner surface of the latch cover 49.

As illustrated in FIG. 1, a clasp arm pin 52 extends through the lower end of the clasp arm 48. The ends of the clasp arm pin 52 extend into holes in the lower end of the latch cover 49, so that the clasp arm 48 is movable up and down. The clasp arm 48 comprises a clasp hand 51 at its upper end. The clasp hand 51 includes a clasp hand screw 58 at its lower end, making the clasp hand rotatable and movable up and down. The clasp hand has a curved upper portion 59. Two short latch cover pins 53 extend through holes in the sides of the latch cover 49 adjacent the lower end of the latch cover, and corresponding holes in the hinge, so that the latch cover 49 is movable up and down over the clasp arm. The latch assembly 15 is shown in an open position in FIG. 1.

Figure 8:
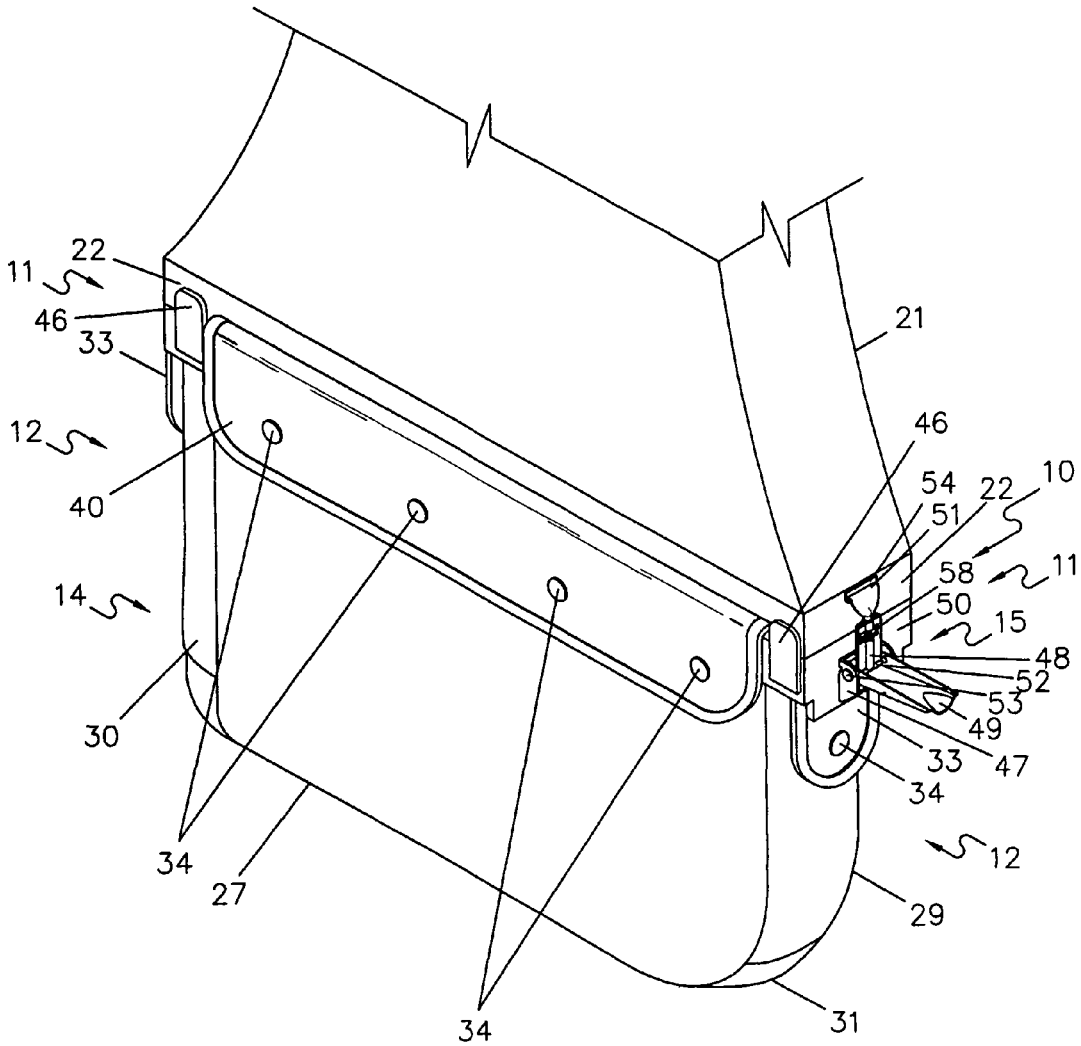
FIG. 8 is a perspective view of a spent brass catch device according to the present invention, shown attached to a machine gun chute.

Once the catch device 10 is assembled as seen in FIG. 1, it is ready for attachment to the machine gun chute 21 or the like (see FIG. 8). This is ordinarily done prior to the tank or other vehicle taking off for the military exercise or other expected use. The frame 22 at the base of the machine gun chute 21 is generally rectangular in shape. Its shape corresponds to the generally rectangular shape of the bag frame 13.

As seen in FIG. 1, the chute frame 22 includes a chute bracket 54 at its first end, and a stepped projection 56 at its opposite, second end. The first end of the chute frame 22 corresponds to the first, latch assembly end of the catch device's frame portion 11 when the catch device is attached to the chute, and the second end of the chute frame 22 corresponds to the second, gusset bar end of the device's frame portion 11. The back of the chute bracket 54 is attached to the outside surface of the first end of the chute frame 22. The bottom of the chute bracket 54 curves out and up into a bracket lip 55 that corresponds to the curved upper portion 59 of the clasp hand 51.

To attach the spent brass catch device 10 to the machine gun chute 21, the assembled catch device 10 is held up at approximately a 45 degree angle, with its second end close to the second end of the chute frame 22. The operator slides the gusset bar 45 of the catch device 10 over the lower step 57 of the chute frame stepped projection 56. The back of the chute frame stepped projection 56 is attached to the inside of the chute frame 22 at its second end, so that the lower step 57 projects into the chute opening 24. The lower step 57 of the chute frame stepped projection 56 and the gusset bar 45 are about the same size. Once the catch device 10 is attached to the chute 21, the gusset bar 45 of the catch device fits closely on top of the lower step 57 of the chute frame stepped projection 56. Even though it is a simple, quick step, sliding the gusset bar 45 onto the lower step 57 importantly pins the second end of the catch device to the chute frame.

Once the second end of the catch device 10 is pinned to the chute frame 22, the first, latch assembly end of the frame portion 11 is pushed up the rest of the way to meet the first end of the chute frame 22, and the latch assembly 15 is latched. To apply the latch, the upper, curved portion 59 of the clasp hand 51 is placed over the lip 55 of the chute bracket 54. The downward curve of the clasp hand 51 fits closely into the upward curve of the bracket lip 55. The latch cover 49 is then closed over the top of the clasp arm 48. When the latch cover 49 is pushed up over the clasp arm 48 into the closed position, the resulting movement of the latch hinge 47 pulls the clasp arm 48 down slightly, which tightens the clasp arm 48 and latches the latch assembly end of the frame portion 11 to the chute 21. When the latch assembly 15 is closed, the clasp arm 48 is attached to its counterpart bracket lip 55 on the chute frame, and the latch cover 49 covers the clasp arm.

When the frame portion 11 is attached to the chute frame 22, the insides of the four tabs 46 contact the outsides of the two longitudinal bars of the chute frame. The tabs 46 help to fix the catch device 10 in place on the chute frame 22 and hold the frame portion 11 steady. The catch device frame portion can similarly be attached to the frames of other types of ejection channels that conduct spent brass from an automatic machine gun.

Since the machine gun vibrates sporadically when it is in use, and the vehicle on which the gun is mounted rolls and oscillates as it moves, the chute bracket 54 and other parts are subjected to a great deal of movement and wear. The clasp hand screw end 58 permits the clasp hand 51 to be moved right and left, or to be screwed up and down in a female, receiving portion of the clasp arm 48. This makes the clasp hand 51 relatively adjustable in case the chute frame bracket lip 55 has moved off center, as occasionally occurs with use.

The spent brass catch device 10 can easily be detached from the machine gun chute 21 or other type of ejection channel after use, if desired, though detachment is not necessary. To remove the catch device 10 from the chute 21, the latch cover 49 is first pulled down (see FIG. 8). The top of the latch cover 49 is slightly bent as shown in FIGS. 4, 5, and 8 to provide a finger hold, making it easier to grasp and pull the latch cover 49 down when it is opened. The clasp hand 51 is removed from the bracket lip 55, allowing the clasp arm 48 to fall down onto the open latch cover 49. The second end of the catch device 10 is then pulled away from the chute frame stepped projection 56. It can be seen that attachment and detachment of the catch device 10 are quick and easy. The catch device can then be disassembled, the collection bag cleaned or replaced, and the catch device reassembled for use, if desired.

From the foregoing it can be realized that the described device of the present invention may be easily and conveniently utilized as a catch device for collecting spent brass from an automatic fire machine gun or other such gun that is mounted in a tank or other platform. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 spent brass catch device
11 frame portion
12 catch bag portion
13 bag frame
14 collection bag
15 latch assembly
16 hollow interior
18 attachment mechanism
20 cross member
21 chute
22 chute frame
23 spent brass
24 chute opening
25 mouth of device
26 bottom zipper
27 bag front section
28 bag rear section
29 latch side gusset
30 second side gusset
31 bag base section
32 bottom slot
33 side gusset tongue
34 cap and socket snap portions
35 post and stud snap portions
36 frame longitudinal rails
37 transverse bag bars
38 zipper pull
39 cross member seams
40 upper flap
41 hook and loop segments
42 flap zipper
43 bottom flap
44 bottom hook and loop strip
45 gusset bar
46 tabs
47 latch hinge
48 clasp arm
49 latch cover
50 latch back plate
51 clasp hand

52 clasp arm pin
53 latch cover pin
54 chute bracket
55 chute bracket lip
56 chute frame stepped projection
57 lower step of stepped projection
58 clasp hand screw end
59 curved portion of clasp hand

What is claimed is:

1. A spent brass catch device for catching and collecting spent brass from an automatic machine gun mounted in a vehicle, the device comprising: (a) a frame portion comprising an open mouthed, rigid bag frame, and a latch assembly mounted on the bag frame; and (b) a catch bag portion comprising a collection bag comprising a bag front section, a bag rear section opposite the bag front section, a latch side gusset between the bag front and rear sections, a second side gusset opposite the latch side gusset, a hollow bag interior, and a defined bag base section, the bag front and rear sections being substantially parallel to one another and substantially perpendicular to the side gussets, a zipper closing a bottom slot extending longitudinally along the bag base section, at least one attachment mechanism at a top of the collection bag, and at least three flexible cross members extending transversely across the bag interior from a front section directly to an opposite rear section of the collection bag only, the cross members extending across a lower portion of the bag and substantially parallel to one other and to the side gussets and substantially perpendicular to the bag front and rear sections;

wherein the catch bag portion is attachable to the frame portion by the attachment mechanism.

2. The spent brass catch device according to claim 1, wherein the bag front section and the bag rear section each extend straight down from the frame portion; and wherein the cross members are not attached to one another or to the bag base section.

3. The spent brass catch device according to claim 2, wherein each of the at least three cross members is attached at its opposite ends to the front and rear sections of the collection bag, respectively, and the bag base section is about the size of a mouth of the frame section.

4. The spent brass catch device according to claim 2, comprising three sets of three of the cross members, the cross members extending across a lower half of the collection bag and dividing the lower half of the bag into four sections, the cross members having substantially the same size as one another and being spaced apart from one another; wherein the cross members are made of a fire resistant webbing material; and wherein the cross members are each about the same length as one of the side gussets.

5. The spent brass catch device according to claim 2, wherein the bag frame comprises two frame longitudinal rails and two transverse bag bars, the frame longitudinal rails being substantially parallel to one another, the transverse bag bars being substantially parallel to one another, the transverse bag bars connecting the frame longitudinal rails.

6. The spent brass catch device according to claim 5, the bag frame further comprising a gusset bar at a second end of the bag frame, and a plurality of tabs attached to the longitudinal rails, the gusset bar being attached to the longitudinal rails; and wherein the latch assembly is mounted on a first, latch assembly end of the bag frame.

7. The spent brass catch device according to claim 6, wherein a first set of two of the plurality of tabs is attached to an outside of second end portions of the longitudinal rails and to opposite ends of the gusset bar, a second set of two of the plurality of tabs is attached to the outside of the opposite, first end portions of the longitudinal rails.

8. The spent brass catch device according to claim 5, wherein the at least one attachment mechanism at the top of the collection bag is a plurality of snaps, the bag front and rear sections each comprising two rows of spaced apart snap portions of the plurality of snaps, an upper row of the snap portions comprising cap and socket snap portions extending along an upper edge of the bag front and rear sections, a second, lower row of the snap portions comprising post and stud snap portions corresponding to the cap and socket snap portions, the catch bag portion being detachable from the frame portion.

9. The spent brass catch device according to claim 8, wherein the bag front and rear sections are symmetrical and each comprise an upper flap, the cap and socket snap portions being aligned with the post and stud snap portions when the upper flap of the bag front section is down, the cap and socket snap portions being aligned with the post and stud snap portions when the upper flap of the bag rear section is down.

10. The spent brass catch device according to claim 9, wherein, when the catch device is assembled, the upper flap of the bag front section extends over one of the frame longitudinal rails, and the upper flap of the bag rear section extends over the other one of the frame longitudinal rails.

11. The spent brass catch device according to claim 10, wherein the side gussets each comprise a tongue, the tongue of the latch side gusset being substantially longer than the tongue of the second side gusset, each of the side gussets further comprising a cap and socket snap portion, and a post and stud snap portion below the cap and socket snap portion, on the gusset tongue.

12. The spent brass catch device according to claim 11, wherein, when the catch device is assembled, the tongue of each side gusset is extended over one of the transverse bag bars at an end of the bag frame, the cap and socket snap portions aligning with corresponding ones of the post and stud snap portions on the respective side gussets.

13. The spent brass catch device according to claim 1, wherein the latch assembly comprises a latch hinge, a clasp arm, and a latch cover, the latch hinge being attached to a latch back plate, the latch back plate being attached to the frame longitudinal rails, a lower end of the clasp arm being hinged to a lower end of the latch cover.

14. The spent brass catch device according to claim 13, wherein the hinged latch cover is movable up and down over the clasp arm, the clasp arm fitting within a recess in an inner surface of the latch cover.

15. The spent brass catch device according to claim 13, wherein the clasp arm comprises a clasp hand at its upper end, the clasp hand comprising a clasp hand screw at its lower end, the clasp hand being rotatable and movable up and down, the clasp hand comprising a curved upper portion.

16. The spent brass catch device according to claim 1, wherein the attachment mechanism for detachably attaching the catch bag portion to the bag frame comprises a plurality of hook and loop segments attached to an upper flap of a front section of the collection bag, and to an upper flap of a rear section of the collection bag.

17. The spent brass catch device according to claim 2, wherein the attachment mechanism for detachably attaching the catch bag portion to the bag frame comprises a flap zipper, a first portion of the flap zipper being attached to the bag front or rear section, a second portion of the flap zipper being attached to an edge of the upper flap of the bag front or rear section.

18. A spent brass catch device for catching and collecting spent brass from a machine gun apparatus mounted on a platform, the catch device comprising: (a) a frame portion for detachable attachment to a corresponding frame of the machine gun apparatus, the frame portion comprising an open mouthed, rigid bag frame, and a latch assembly attached to an end portion of the bag frame; and (b) a catch bag portion comprising a collection bag having a hollow interior, at least one attachment mechanism at a top of the collection bag, and at least three sets of three separate, spaced apart flexible cross members extending across the collection bag interior from a front section to a rear section of the collection bag; wherein the collection bag comprises an openable slot extending longitudinally across a bottom of the collection bag, and a bottom flap at the bottom of the collection bag that is extendible over the bottom slot, the bottom flap comprising a hook and loop strip for detachably attaching the bottom flap to the collection bag; the catch bag portion being detachably attachable to the frame portion; wherein the collection bag further comprises a bag front section, a bag rear section opposite the bag front section, a latch side gusset between the bag front and rear sections, a second side gusset opposite the latch side gusset, and a defined bag base section, the bag front and rear sections being substantially parallel to one another and substantially perpendicular to the side gussets; wherein the cross members extend substantially parallel to one other and to the side gussets and substantially perpendicular to the bag front and rear sections; and wherein the attachment mechanism comprises a plurality of snaps attached to a tongue of each of the two side gussets of the collection bag.

19. The spent brass catch device according to claim 18, wherein the attachment mechanism further comprises a plurality of snaps attached to an upper flap of a front section of the collection bag, and to an upper flap of a rear section of the collection bag.

20. The spent brass catch device according to claim 18, wherein the attachment mechanism, which is for detachably attaching the catch bag portion to the bag frame, comprises a plurality of hook and loop segments attached to an upper flap of a front section of the collection bag, and to an upper flap of a rear section of the collection bag.

* * * * *